US008719970B2

(12) United States Patent
Arvizu

(10) Patent No.: US 8,719,970 B2
(45) Date of Patent: May 13, 2014

(54) ODOR VENTILATION SYSTEM

(76) Inventor: Julio Arvizu, Lahaina Maui, HI (US)

( * ) Notice: Subject to any disclaimer, the term of this patent is extended or adjusted under 35 U.S.C. 154(b) by 611 days.

(21) Appl. No.: 12/955,976

(22) Filed: Nov. 30, 2010

(65) Prior Publication Data

US 2012/0131737 A1 May 31, 2012

(51) Int. Cl.
*E03D 9/04* (2006.01)

(52) U.S. Cl.
USPC ..... 4/213; 4/209 R

(58) Field of Classification Search
USPC ..... 4/209 R, 213
See application file for complete search history.

(56) References Cited

U.S. PATENT DOCUMENTS

2006/0085898 A1* 4/2006 Rosa ..... 4/213

* cited by examiner

*Primary Examiner* — Tuan N Nguyen
(74) *Attorney, Agent, or Firm* — The Law Office of Jerry D. Haynes

(57) ABSTRACT

An odor ventilation system for a bathroom comprising: a venting assembly, where said venting assembly is installed under a toilet seat; an air hose assembly, where said hose assembly connects to the venting assembly at a first end; a fan motor, where said fan motor connects to the hose assembly at a second end; and a vent opening, where said hose assembly continues from the fan motor to the vent opening and said hose assembly transfers odors from the toilet seat to the vent opening.

3 Claims, 1 Drawing Sheet

ODOR VENTILATION SYSTEM

BACKGROUND OF THE INVENTION

1. Field of Invention

The present invention relates to an odor ventilation system for a restroom or bathroom.

2. Description of Related Art

Bathroom odors occasionally linger after use thereof. Consequently, the odor that may be associated with bathroom usage may drift from the bathroom into an adjoining room and any subsequent user may be forced to endure the unpleasant smells while using the bathroom. Methods of controlling odors associated with bathrooms include using ventilation systems and deodorizers in the bathroom. The most common ventilation system used in a bathroom is a ceiling vent that attempts to expel odors through the use of a fan and venting system. Also deodorizers are placed in the toilet and bathroom area in order to emit fragrances that diminish the affects of bathroom odors.

Some ventilation systems used in the prior art include ventilation systems that attempt to direct air directly from the toilet area into a vent to be expelled out of the bathroom prior to the odor being emitted throughout the bathroom. U.S. Pat. No. 5,305,472 discloses a ventilation unit for a toilet that induces airflow through the water passageway of a conventional toilet bowl and attempts to direct odors and aromas out of the toilet to a wall vent via piping surrounding the toilet.

U.S. Pat. No. 6,944,888 discloses a toilet seat weight-sensing switch that connections to a fan that activates when the toilet seat is sat upon. When the switch is activated it generates a pulse turning on a logic gate that generates a pulse that turns on a fan where the fan directs odor from the toilet directing the odor into a venting system positioned behind the toilet assembly.

SUMMARY OF THE INVENTION

The present invention relates to an odor ventilation system for a bathroom comprising: a venting assembly, where said venting assembly is installed under a toilet seat; an air hose assembly, where said hose assembly connects to the venting assembly at a first end; a fan motor, where said fan motor connects to the hose assembly at a second end; and a vent opening, where said hose assembly continues from the fan motor to the vent opening and said hose assembly transfers odors from the toilet seat to the vent opening.

DETAILED DESCRIPTION

Figure 1:
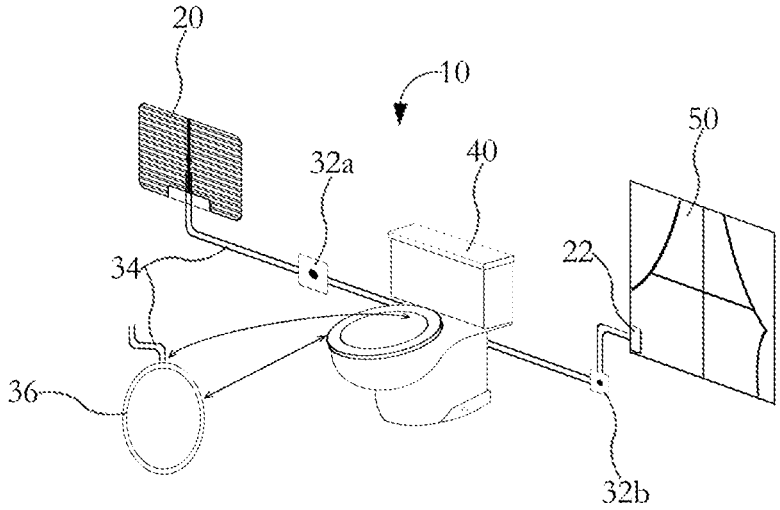
FIG. 1 depicts an odor ventilation system according to the present invention.

The present invention provides an odor ventilation system utilized in a bathroom in conjunction with a toilet. The odor ventilation system according to present invention provides a means to remove odors directly from the toilet area and expel the odor to an outside environment via either a vent or through a window. The venting system is initiated within and under the toilet seat and therefore attempts to eliminate odors prior to being emitted through the bathroom.

The odor ventilation system 10 as depicted in FIG. 1 includes a motor, which is attached to a venting system that is initiated in and around the toilet seat. Toilet 40 includes a venting assembly 36, which is adapted for placement under the toilet seat. The venting system 10 attaches to air hoses 34, which extend from the rear side of the toilet. The air hoses travel through a motorized fan and the motorized fan extracts the air and odors into a vent 20 or may direct the odors to a window 50.

FIG. 1 depicts two exemplary embodiments of the ventilation system 10 according to the present invention. Motor 32*a* directs air to a vent 20 that is extracted from the toilet 40. This configuration may be used in a house or apartment, which lacks a window or other opening to the outdoor environment. The ventilation system 10 therefore captures the odors as they may be emitted within the toilet and directs them immediately to the vent 20. As an alternative, a window 50 with a vent opening 22 may be provided in the bathroom where a motor 32*b* extracts odors directly from the toilet and emits the odors to the vent 22, which is part of the window 50 as depicted in FIG. 1. The venting assembly 36 attaches to the underside of the toilet seat and connects to the air hose 34. The air hose 34 may be directed through the motor 32*a*, 32*b* and then the odor or fumes transferred to a vent 20 or vent 22 on outside window 50.

Although the vent 20 is depicted adjacent to the toilet 40, it may be positioned on the ceiling or the hose 34 may be directed through the ceiling of the bathroom to a roof vent on top of the building. Furthermore, the air system may be placed inside the walls so that the venting system is not visible when an individual enters into the bathroom. The motor 32 may be powered using an AC power connection to the building electrical power system. A wall switch or a push button provided in the bathroom may activate the motor 32. The odor ventilation system 10 according to present invention may be activated by the individual before, during and after the use of the bathroom and may be incorporated with any existing bathroom as well as new construction. The odor ventilation system 10 according to present invention helps to direct odors out of the bathroom and therefore alleviates problems associated with bathroom odors. The instant invention has been shown and described in what it considers to be the most practical and preferred embodiments. It is recognized, however, that departures may be made there from within the scope of the invention and that obvious modifications will occur to a person skilled in the art.

What is claimed is:

1. An odor ventilation system for a bathroom comprising:

a. a venting assembly, where said venting assembly is installed under a toilet seat;

b. a first air hose assembly, where said first hose assembly connects to the venting assembly at a first end;

c. a second air hose assembly, where the second hose assembly connects to the venting assembly at a first end;

d. a first fan motor, where said first fan motor connects to the first hose assembly at a second end;

e. a second fan motor, where said second fan motor connects to the hose assembly at a second end;

f. a vent opening, where said first hose assembly continues from the first fan motor to the vent opening and said first hose assembly transfers odors from the toilet seat to the vent opening; and g. a window opening, where said second hose assembly continues from the second fan motor to the window opening and said second hose assembly transfers odors from the toilet seat to the window opening.

2. The odor ventilation system according to claim 1, where each fan motor is powered by AC power.

3. The odor ventilation system according to claim 2 further including a switch to activate each fan motor.

* * * * *